United States Patent [19]

Nomura et al.

[11] 4,244,322

[45] Jan. 13, 1981

[54] MAGNETIC BRUSH TYPE DEVELOPING APPARATUS

[75] Inventors: Yutaka Nomura, Yokohama; Mitsuaki Koyama, Higashikurume; Masahiro Katou, Yokohama, all of Japan

[73] Assignee: Tokyo Shibaura Electric Co., Ltd., Kawasaki, Japan

[21] Appl. No.: 884,622

[22] Filed: Mar. 6, 1978

[30] Foreign Application Priority Data

Mar. 11, 1977 [JP] Japan ..... 52-26708

[51] Int. Cl.[3] ..... G03G 15/09

[52] U.S. Cl. ..... 118/658; 430/122; 118/657

[58] Field of Search ..... 118/658, 657; 96/150; 430/122

[56] References Cited

U.S. PATENT DOCUMENTS

| | | | |
|---|---|---|---|
| 3,915,121 | 10/1975 | Wilcox | 118/658 |
| 4,030,447 | 6/1977 | Takahashi et al. | 118/658 |
| 4,089,297 | 5/1978 | Morita et al. | 118/658 |

FOREIGN PATENT DOCUMENTS

| | | |
|---|---|---|
| 37-14798 | 9/1962 | Japan . |
| 48-31956 | 4/1973 | Japan . |

*Primary Examiner*—Dennis E. Talbert, Jr.
*Assistant Examiner*—John L. Goodrow
*Attorney, Agent, or Firm*—Cushman, Darby & Cushman

[57] ABSTRACT

A developing apparatus includes a cylindrical drum having a photosensitive layer provided around the outer peripheral surface thereof, and a magnetic roller mounted within a receptacle and having permanent magnets oriented in a body thereof and a rotating cylindrical sleeve provided on the outer peripheral surface of the body thereof. The receptacle holds a developer mixture including powdered iron and toner and it is opened to provide a magnetic brush exposure window where the magnetic roller and cylindrical drum face each other with a gap left therebetween. The magnetic roller continuously supplies the developer mixture in the form of a magnetic brush toward the gap between the magnetic roller and the cylindrical drum. A doctor blade is attached to the lowest edge portion of the exposure window to restrict the thickness of the magnetic brush. A magnetic piece is attached to the outer surface of the doctor blade and attracts the powdered iron in the magnetic brush thereto due to a magnetic field created between the permanent magnet in the magnetic roller and the magnetic piece, thereby providing an iron powder curtain between the magnetic brush and the magnetic piece. The curtain serves to prevent the developer mixture from flying off onto the photosensitive layer on the cylindrical drum and to permit the toner powder in the developer mixture to be effectively charged through a frictional contact with the curtain.

5 Claims, 3 Drawing Figures

MAGNETIC BRUSH TYPE DEVELOPING APPARATUS

BACKGROUND OF THE INVENTION

This invention relates to an electrostatic printing apparatus and in particular to a developing apparatus utilizing a magnetic brush.

A developing apparatus is already known which utilizes a magnetic brush to clean a photosensitive layer of a cylindrical drum or to develop an electrostatic latent charge image formed on the photosensitive layer of the cylindrical drum. An electrostatic printing apparatus equipped with a developing apparatus is manufactured and put on sale. However, it is generally pointed out that such conventional apparatus have a disadvantage as set out below. That is, when a paper sheet is copied on the conventional apparatus, a black-band stain or mark appears on the copied paper sheet. As a result of investigation it has been found that such black-band stain or mark occurs for the reason set out below.

When the cylindrical drum is at rest, a magnetic brush is contacted with the photosensitive layer of the magnetic drum and some toner powders or particles are attached to the contacted area of the photosensitive layer of the magnetic drum. Such toner powders remain there, while the magnetic drum continues to be rotated, causing a black-band smear to occur on a copied paper sheet. It has been found that such smear can be partially eliminated by electrostatically attracting such attached toner powders away from the photosensitive layer of the magnetic drum. It has also been found that the smear can not completely removed merely by such an electrostatic attraction method. As a result of further investigation it has been found that when the developing apparatus starts to be rotated, i.e. the magnetic roller starts to be rotated, some toner powders fly off onto the photosensitive layer of the cylindrical drum from near the doctor blade due to vibrations and they are deposited there. A demand is, therefore, made for a means for preventing some toner powders from flying off onto the photosensitive layer of the cylindrical drum from near the doctor blade.

SUMMARY OF THE INVENTION

An object of this invention is to provide a magnetic brush type developing apparatus, which prevents a black-band stain or mark from occurring on a copied paper sheet.

Another object of this invention is to provide a magnetic brush developing apparatus, which prevents some toner powders from flying onto the photosensitive layer of the cylindrical drum from near the doctor blade.

According to this invention there is provided a developing apparatus, comprising a cylindrical drum having a photosensitive layer provided on the outer peripheral surface thereof and on which an electrostatic latent charge image is formed; a magnetic roller disposed opposite to the photosensitive layer of the cylindrical drum with a gap left therebetween and having permanent magnets arranged in a predetermined array in a roller body thereof with their polarity oriented and a rotating cylindrical sleeve provided around the outer surface thereof and on which a magnetic brush is formed; a receptacle made of non-magnetic material and within which said magnetic roller is mounted and in which a developer mixture comprising iron powder and toner powder is held, said receptacle having a magnetic brush exposure window opened to permit said magnetic roller and said cylindrical drum to face each other; a doctor blade attached to that edge of said magnetic brush exposure window from which the magnetic brush emerges, said doctor blade being located near to a closest gap between said magnetic roller and said cylindrical drum to restrict the thickness of the magnetic brush; and a magnetic piece attached to the doctor blade to attract the iron powder in the magnetic brush thereto by a magnetic force between the magnet in the body of the magnetic roller and the magnetic piece to form a magnetic powder curtain between the magnetic brush and the magnetic piece.

BRIEF DESCRIPTION OF THE DRAWINGS

This invention will now be described by way of example by referring to the accompanying drawing, in which.

DETAILED DESCRIPTION OF THE PREFERRED EMBODIMENT

Figure 1:
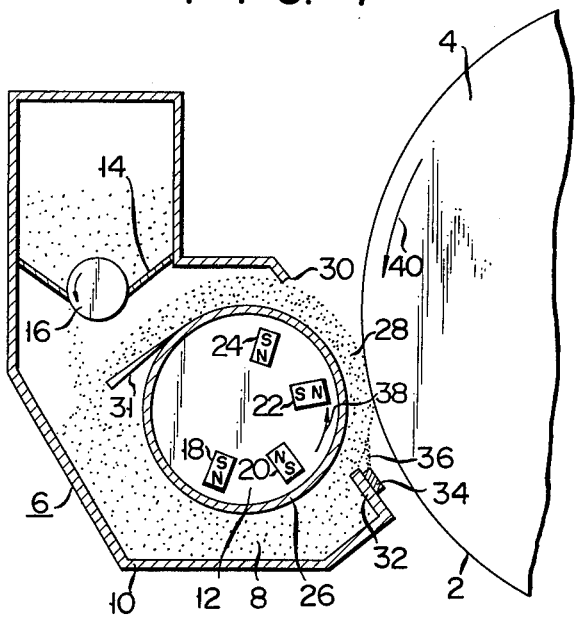
FIG. 1 is a view, partly in cross section, showing a major part of a developing apparatus according to one embodiment of this invention.

FIG. 1 schematically shows a major part of a developing apparatus according to one embodiment of this invention. The developing apparatus comprises a cylindrical drum 4 having a photosensitive layer 2 on which an electrostatic latent charge image is formed, and a developer powder supplying device 6 for supplying a powdered developer onto the photosensitive layer to develop the electrostatic latent charge image. The developer powder supply device 6 includes a developer mixture holding receptacle 10 made of a non-magnetic material and adapted to receive a developer mixture 8. A magnetic roller 12 is mounted within the receptacle 10. The developer mixture comprises a powdered developer or toner and a magnetic carrier such as a powdered iron. A toner hopper 14 is provided within the developer mixture holding receptacle 10. A toner supply roller 16 is mounted at the toner supply mouth or opening of the toner hopper 14 to permit the toner powder or particle to be supplied by the toner supply roller 16 from the toner hopper 14 toward the neighborhood of the magnetic roller. The magnetic roller 12 includes, as shown in FIG. 1, a cylindrical body having four permanent magnets 18, 20, 22 and 24 provided in a predetermined array with the angle and polarity indicated, and a rotating cylindrical sleeve 26 made of a non-magnetic material and adapted to be rotated counterclockwise around the body. The rotating sleeve 26 is connected to a drive means such as a motor and gear (not shown). A magnetic brush exposure window 30 is provided on the receptacle 10 to permit the magnetic roller 12 to face the cylindrical drum 4 and, in consequence, to permit a magnetic brush 28 on the roller 12 to be exposed into contact with the photosensitive layer 2 on the cylindrical drum 4. A scraping member 31 is provided within the receptacle 10 to scrape off the developer mixture 8 which is carried on the surface of the sleeve 26 when the sleeve 26 is rotated. That is, the tip of the scraping member 31 is contacted with the surface of the sleeve 26 of the magnetic roller 12 and scrapes off the developer mixture 8 which is carried back into the receptacle 10 after it has been contacted with the photosensitive layer 2 on the cylindrical drum. The scraped developer mixture 8 is dropped down toward the bottom of the receptacle. A doctor blade 32 is mounted at the magnetic brush emerging side of the exposure window, i.e., on the lowest edge portion of the exposure window, to restrict the thickness of the magnetic brush. The doctor blade 32 is located near a closest gap between the magnetic roller and the cylindrical drum. The doctor blade 32 is made of non-magnetic material such as aluminium and extends toward a middle position between the permanent magnets 20 and 22 in the magnetic roller body. As will be shown in greater detail in FIG. 2 a relatively thin magnetic member 34 such as an iron piece is attached to the outer surface of the doctor blade 32.

Figure 2:
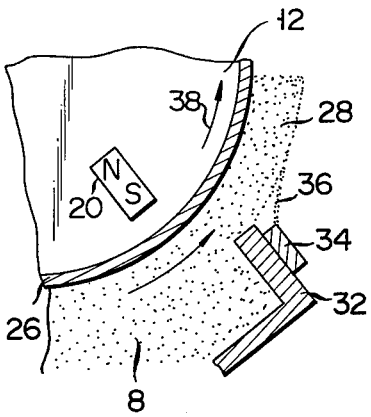
FIG. 2 is a partially enlarged, cross-sectional view showing the developing apparatus of FIG. 1.

The magnetic member 34 is relatively weakly magnetized by the permanent magnet in the magnetic roller 12 to create a magnetic field therebetween. As a result, some iron powders in the magnetic brush 28 are attracted to the magnetic member 34 to form an iron powder curtain therebetween as shown in FIGS. 1 and 2.

Figure 3:
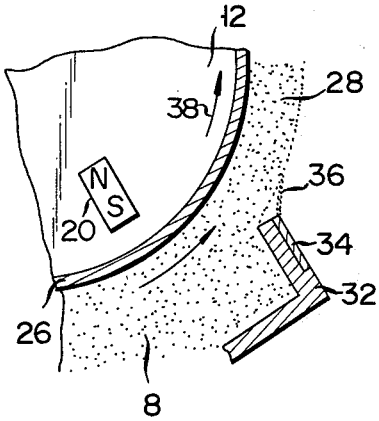
FIG. 3 is a partially enlarged, cross-sectional view showing a modified form of the developing apparatus of FIG. 1.

The magnetic member 34 may be integrally embedded in the doctor blade 32, as shown in FIG. 3, to permit part thereof to be exposed to the outside. Since an iron powder curtain 36 is formed between the magnetic brush 28 and the magnetic member 34, it is not preferred that the magnetic member 34 be contacted directly with the magnetic brush 28. Therefore, a desirable pattern of iron powder curtain can not be formed even if the doctor blade 32 is made of magnetic material.

In operation, the sleeve 26 and cylindrical drum 4 are both rotated in the counterclockwise direction 38, 40. There is a possibility that some amount of developer mixture 8 will be deposited onto the forward end portion of the doctor blade 32. Irrespective of whether the developing apparatus is operated or stopped, a desirable pattern of iron powder curtain 36 is always formed between the magnetic brush and the magnetic member 34 and, in consequence, the developing powder 8 is hardly deposited onto the forward end portion of the doctor blade. Even if the developer mixture 28 is deposited onto the forward end portion of the doctor blade 32 and the deposited developer mixture flies away due to vibrations etc., it strikes against the curtain 36 to prevent it from flying off onto the photosensitive layer 2 on the cylindrical drum 4. As a result, paper sheets can be copied on electrostatic printing apparatus, equipped with the developing apparatus according to this invention, without leaving no black-band like stain or mark.

The toner and iron powders or particles, both constituting the developer mixture, are frictionally stirred on the bottom of the receptacle 10 and in consequence the toner powder is electrically charged. All the toner is not electrically completely charged and "fogging or background" will occur on a copied paper due to some insufficiently charged toner particles. Such a fogging can be prevented according to the developing apparatus of this invention, as will be described below.

That is, the toner particle of the magnetic brush is, before being contacting with the surface of the photosensitive layer 2 on the cylindrical drum 4, is frictionally contacted with the iron powder curtain 36, causing it to electrically charged. As a result, the toner particle is not deposited on other than the electrostatic latent charge image areas of the photosensitive layer 2 and no fogging occurs on a copied paper sheet. Experiments were conducted under the condition that the toner was deposited onto the paper sheet in high concentration, and it has been found that the logarithmic scale reflection density of "fogging" is 0.2 in the conventional apparatus and as low as below 0.02 in the apparatus according to this invention.

What we claim is:

1. A developing apparatus utilizing a magnetic brush, comprising a cylindrical drum having a photosensitive layer provided on the outer peripheral surface thereof and on which an electrostatic latent charge image is formed; a magnetic roller disposed opposite to the photosensitive layer of the cylindrical drum with a gap left therebetween and having permanent magnets arranged in a predetermined array in a roller body thereof with their polarity oriented and a rotating cylindrical sleeve provided around the outer surface thereof and on which a magnetic brush is formed; a receptacle made of non-magnetic material and within which said magnetic roller is mounted and in which a developed mixture comprising iron powder and toner powder is held, said receptacle having a magnetic brush exposure window opened to permit said magnetic roller and said cylindrical drum to face each other; a doctor blade made of non-magnetic materials having a first end and a second end attached at said first end to that edge of said magnetic brush exposure window from which the magnetic brush emerges, said doctor blade being located near to a closest gap between said magnetic roller and said cylindrical drum to restrict the thickness of the magnetic brush; and a magnetic piece attached to said doctor blade to attract the iron powder in the magnetic brush thereto by a magnetic force between said permanent magnets in said body of said magnetic roller and said magnetic piece to form a magnetic powder curtain between the magnetic brush and said magnetic piece so as to inhibit toner powder from depositing on said doctor blade second end and blocking said toner powder from flying off of said doctor blade onto said photosensitive layer.

2. A developing apparatus according to claim 1, in which said magnetic piece is mounted on the surface of said doctor blade.

3. A developing apparatus according to claim 1, in which said magnetic piece is embedded in the doctor blade to permit part thereof to be exposed to the outside.

4. A developing apparatus according to claim 1 wherein said magnetic piece is deposited between said doctor blade and said cylindrical drum so that said magnetic powder curtain is formed between said doctor blade and said cylindrical drum.

5. A developing apparatus according to claim 1 or claim 4, wherein said doctor blade is disposed between all of said magnetic piece and said magnetic roller so that said magnetic piece is not exposed to said magnetic brush.

* * * * *